United States Patent [19]

Goyal

[11] Patent Number: 4,719,006

[45] Date of Patent: Jan. 12, 1988

[54] PROCESS AND SYSTEM CONTINUOUSLY REMOVING ARSENIC FROM SHALE OIL WITH A CATALYST AND REGENERATING THE CATALYST

[75] Inventor: Shri K. Goyal, Naperville, Ill.

[73] Assignee: Amoco Corporation, Chicago, Ill.

[21] Appl. No.: 761,198

[22] Filed: Jul. 31, 1985

[51] Int. Cl.[4] ..... C10G 25/00

[52] U.S. Cl. ..... 208/251 R; 208/177; 208/250; 502/25; 502/516; 423/87

[58] Field of Search ..... 208/251 R, 251 H; 502/25, 516; 423/87

[56] References Cited

U.S. PATENT DOCUMENTS

| | | | |
|---|---|---|---|
| 1,952,290 | 3/1934 | Schopper | 423/87 |
| 2,779,715 | 1/1957 | Murray et al. | 208/88 |
| 2,867,577 | 1/1959 | Urban, Jr. et al. | 208/251 H |
| 2,905,625 | 9/1959 | Berger | 208/251 H |
| 2,955,089 | 10/1960 | Gleim | 502/25 |
| 3,177,158 | 4/1965 | Gleim | 502/516 |
| 3,240,718 | 3/1966 | Gatsis | 502/516 |
| 3,483,137 | 12/1969 | Sensel | 502/25 |
| 3,650,983 | 3/1972 | Miller | 502/25 |
| 3,804,750 | 4/1974 | Myers et al. | 208/251 H |
| 3,824,193 | 7/1974 | Williams | 502/25 |
| 3,959,382 | 5/1976 | Yeh et al. | 502/25 |
| 4,003,829 | 1/1977 | Burger et al. | 208/251 H |
| 4,046,674 | 9/1977 | Young | 208/251 H |
| 4,069,140 | 1/1978 | Wunderlich | 208/251 H |
| 4,083,924 | 4/1978 | Styring | 208/251 R |
| 4,101,444 | 7/1978 | Burk et al. | 502/25 |
| 4,163,710 | 8/1979 | Burk et al. | 502/516 |
| 4,234,452 | 11/1980 | Burk, Jr. et al. | 502/516 |
| 4,353,927 | 10/1982 | Shi et al. | 208/251 H |
| 4,424,118 | 1/1984 | Runkel | 208/251 R |
| 4,439,313 | 3/1984 | Schindler et al. | 208/251 R |
| 4,501,652 | 2/1985 | Le et al. | 208/251 R |
| 4,518,490 | 5/1985 | Fish | 208/251 R |
| 4,552,852 | 11/1985 | Fish | 208/251 R |
| 4,601,998 | 7/1986 | Olick et al. | 502/322 |
| 4,604,191 | 8/1986 | Fish | 208/251 R |
| 4,634,579 | 1/1987 | Maurel | 423/87 |

*Primary Examiner*—Patrick P. Garvin
*Assistant Examiner*—Helane Myers
*Attorney, Agent, or Firm*—Thomas W. Tolpin; William H. Magidson; Ralph C. Medhurst

[57] ABSTRACT

Arsenic can be continuously removed from shale oil by passing the shale oil through a first guard bed containing catalyst capable of substantially reducing the arsenic content of the oil, until the desired amount of arsenic is removed. The flow of the shale oil is thereafter directed to an intercommunicating second guard bed containing another or similar catalyst capable of substantially reducing the arsenic content of the oil. Concurrently, the spent catalyst in the first bed is regenerated in situ so that continuous upgrading of the shale oil is achieved.

17 Claims, 4 Drawing Figures

PROCESS AND SYSTEM CONTINUOUSLY REMOVING ARSENIC FROM SHALE OIL WITH A CATALYST AND REGENERATING THE CATALYST

BACKGROUND OF THE INVENTION

This invention relates to oil shale and more particularly to continuously removing arsenic from shale oil with a catalyst and regenerating the catalyst in situ without interrupting operations.

Researchers have now renewed their efforts to find alternative sources of energy and hydrocarbons in view of past rapid increases in the price of crude oil and natural gas. Much research has been focused on recovering hydrocarbons from solid hydrocarbon-containing materials such as oil shale, coal and tar sands by pyrolysis or upon gasification or by solvent extraction, hydrolysis, beneficiation and retorting or combinations thereof, to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming.

The remainder is contained in the leaner Devonian-Mississipian black shale deposits which underlie most of the eastern part of the United States.

As a result of dwindling supplies of petroleum and natural gas, extensive efforts have been directed to improved methods of processing shale oil. One problem encountered in such processing is the necessity for removing contaminants or impurities which would poison expensive catalysts, such as platinum catalysts and the like, that are used to upgrade light fractions of shale oil and other hydrocarbonaceous fluids before they can satisfactorily be used as a source of energy.

Arsenic is one of the components of raw shale oil which is present at several orders of magnitude higher concentration than in conventional crude oil, and which acts as a reforming and hydrotreating catalyst poison because of its affinity for the metals platinum, cobalt, nickel, and the like. Arsenic also absorbs on the active sites of the hydroprocessing catalysts used to remove nitrogen from whole shale oil. Since arsenic poisons most of the catalysts currently used for refining oil, the arsenic in shale oil must be removed before shale oil can be piped into a conventional refinery. Generally, it is desirable to reduce the level of arsenic in the naphtha fraction to 5 ppb or less before catalytic reforming. Even if the shale oil is employed directly as a fuel, removal of such contaminants may be desirable from the environmental standpoint. Thus, it is desirable that contaminants such as arsenic be removed or reduced to low levels prior to use or further processing.

Generally, oil shale is a fine-grained sedimentary rock stratified in layers with a variable richness of kerogen content. Kerogen has a limited solubility in ordinary solvents and therefore may not be economically recovered by extraction. Upon heating oil shale to a sufficient temperature, the kerogen is thermally decomposed to liberate vapors, mist and liquid droplets of shale oil and light hydrocarbon gases such as methane, ethane, propane, and propene, as well as other products such as hydrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil", is the liquid oil product recovered from the liberated effluent of an oil shale retort.

Untreated shale oil contains various contaminants such as nitrogen, sulfur, oxygen and trace metals, such as arsenic, iron, vanadium and nickel. Aresenic is generally present at levels of from 2 to 80 wppm in full range shale oil, and at levels of from 20 to 1200 wppm in many coal tar distillates. These contaminants must be substantially removed from the shale oil in order to produce a marketable, high quality oil product. Further, several of the trace elements found in whole shale oil, including arsenic, can adversely affect operation with both conventional cracking and hydrogenation catalysts. Most of the trace elements in shale oil are concentrated in the heavy end. However, arsenic is distributed throughout the boiling range of the raw shale oil and various fractions imply the presence of organic arsenic compounds, although the nature of arsenic contained in shale oil is not fully understood. One study suggests that about half of the total arsenic in shale oil is in organometallic form and the other half is in inorganic form. Some of the organometallic arsenic compounds are thermally unstable and volatilize upon heating and become part of the lighter liquids. Therefore, the majority of the arsenic must be removed by other means.

Many different arsenic removal processes have been studied and employed. The most promising and widely studied and used is the fixed bed catalyst process in which the retorted shale oil is passed through a fixed guard bed which contains a catalyst capable of removing or reducing the arsenic content of shale oil to acceptable levels. The guard bed is generally a pressure vessel adapted to withstand the temperatures and pressures needed to remove elemental or combined arsenic and is charged with a suitable catalyst capable of removing the arsenic from the shale oil. See U.S. Pat. Nos. 3,876,533; 4,003,829; 4,046,674; 4,188,280; 4,051,022; 3,933,624; 3,954,603; 3,093,574; 4,446,006; 4,069,140; 4,424,118; 4,141,820; and 4,075,085.

Regardless of the catalyst or process conditions employed, plugging problems have been encountered when the average arsenic deposited on the catalyst is between five and ten percent, generally seven percent, of the catalyst weight resulting in a relatively short catalyst life and necessitating shutting down the dearsenation process while spent catalyst is removed and the guard bed charged with fresh catalyst.

A further drawback to prior art methods is the problem of disposal of the spent catalyst. After a period of time, for example two months, depending upon the catalyst and the arsenic content of the feed, the catalyst becomes saturated with arsenic and does not continue to absorb that contaminant. At this stage, breakthrough occurs and the arsenic contained in the feed reaches the main hydroprocessing reactors and poisons the catalysts employed therein.

Removal of the spent catalyst creates several problems. The first is the downtime involved with the removal of spent catalyst, loading the bed with fresh catalyst and preparing the fresh catalyst bed for operation. The second and equally serious problem is that of waste disposal. Arsenic-containing catalysts are considered to be hazardous waste products, and pose a serious disposal problem. It is generally desirable to avoid combusting spent catalyst for environmental reasons in order to avoid polluting the atmosphere. In order to be disposed of as non-hazardous waste, the arsenic content of the spent catalyst must be reduced to about 0.3 weight percent prior to disposal, and the aqueous solubility of arsenic, as measured by the standard EPA Toxicity test must be less than 5 ppm.

Careful investigation has shown that thus far, attempts to passivate or fix the arsenic on the catalyst in an insoluble form to successfully pass the EPA Toxicity test have not succeeded. The only other alternative is to regenerate the catalyst so that it may be reused, rather than being disposed of.

The prior art suggests several methods for regenerating catalysts. U.S. Pat. No. 4,272,400 discloses a method of regenerating spent alumina catalyst supports impregnated with Group VIB and VIII metals used to reduce sulfur content in an acid media and sulfurous atmosphere and at temperatures of from 400°–825° C. Acid media are unsuitable, however, to regenerate spent arsenic guard bed catalysts, as the acid attacks the catalyst itself.

U.S. Pat. No. 3,761,400 discloses a method of catalyst rejuvenation which entails tumbling the catalyst pellets or particles to grind away the outer surface. Not only does this process require removal of the catalyst from the guard bed, and hence interruption of the operation, but its use is limited and the method cannot be employed repeatedly without destroying the catalyst.

U.S. Pat. No. 4,227,027 discloses a method of reactivating arsenic-poisoned noble metal catalysts by purging the catalyst with an arsenic-free gas such as arsenic-free ethylene combined with acetylene. This method is not suitable for the present purposes.

The present invention fulfills a long standing need by providing a method of continuously removing arsenic from shale oil and regenerating the spent catalyst in situ without interrupting operations, or requiring fresh catalyst. Thus, the process of the present invention eliminates down-time, extends the life of the guard bed catalyst, reduces costs, and satisfactorily solves the problem of arsenic removal and disposal.

SUMMARY OF THE INVENTION

An improved process of continuously removing arsenic from shale oil and regenerating the arsenic-removing absorber (spent catalyst) without interrupting operations is provided. Advantageously, the process increases the life of the catalyst bed and eliminates interruptions in the pretreatment process cycle, thereby increasing efficiency and reducing costs.

In the novel process, crude shale oil is passed through a first guard bed containing a catalyst capable of removing or substantially reducing the arsenic content thereof until the catalyst in the first guard bed is spent. The flow of crude shale oil is then shunted to a second guard bed, and while the dearsenation process continues in the second guard bed, the spent catalyst contained in the first guard bed is regenerated in situ. Such regeneration can include drying, treatment with a regeneration wash comprising water or aqueous alkaline solution, and sulfiding. Purified retort water may conveniently be recycled to provide a source of wash water for the regeneration process.

Generally speaking, two or more guard beds are preferably employed in the practice of this invention for best results.

The term "retort water" as used herein means water and/or condensed water vapor (steam) which has been liberated during the retorting and/or moisturization of synthetic fuels.

The term "synthetic fuels" and "solid hydrocarbon-containing material" as used herein mean oil shale.

The terms "retorted oil shale", "retorted hydrocarbon-containing material", and "retorted synthetic fuels" as used herein refer to oil shale, solid hydrocarbon-containing material, and synthetic fuels, respectively, which have been retorted to liberate hydrocarbons leaving an inorganic material containing carbon residue.

The terms "spent oil shale", "spent hydrocarbon-containing material", and "spent synthetic fuels" as used herein mean oil shale, solid hydrocarbon-containing material, and synthetic fuels, respectively, from which most of the carbon residue has been removed by combustion.

The term "spent catalyst" as used herein means a catalyst which has been used to increase the reaction rate in upgrading a feedstock, such as synthetic oil.

The term "synthetic oil" as used herein means oil which has been produced from oil shale.

The term "syncrude" as used herein means dedusted synthetic oil which has been upgraded in one or more reactors.

The term "dust" as used herein means particulates derived from oil shale, solid hydrocarbon-containing material, or synthetic fuels. The particulates range in size from less than 1 micron to 1,000 microns and include retorted, combusted and raw unretorted particles of oil shale.

The term "ppm" refers to parts per million.

The term "wppm" refers to weight parts per million.

The terms "arsenic" and "arsenic component" are used interchangeably herein and are intended to include arsenic in whatever form, elemental or combined, it may be present. Except where otherwise stated, arsenic concentrations referred to in this Patent Application pertain to elemental arsenic.

A more detailed explanation of the invention is provided in the following description and appended claims taken in conjunction with the accompanying drawings.

DETAILED DESCRIPTION OF PREFERRED EMBODIMENTS

Figure 1:
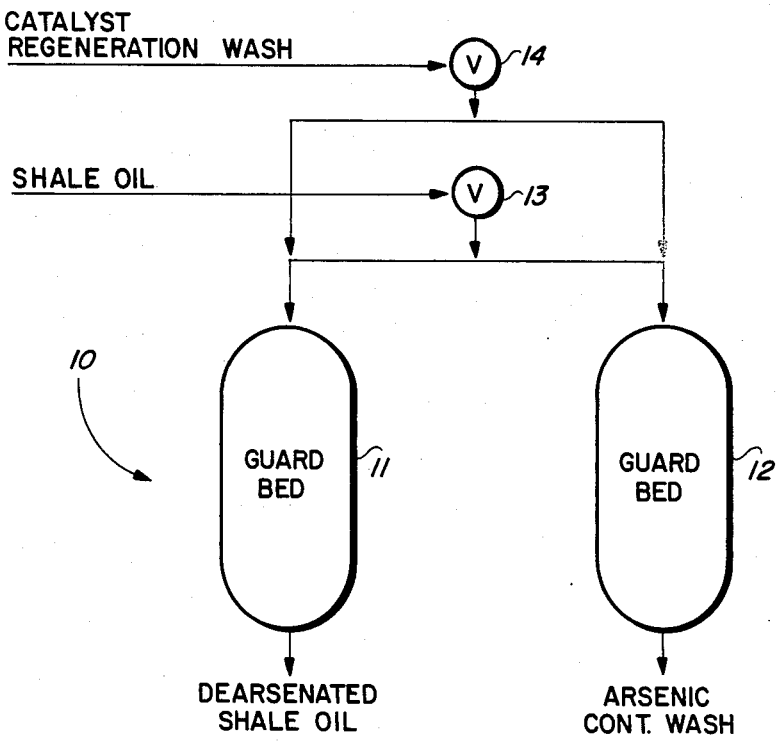
FIG. 1 is a schematic flow diagram of part of a multiple guard bed shale oil dearsenation process in accordance with the principles of the present invention.

In the practice of the present invention, feedstock containing at least 2 ppm arsenic is passed through a first fixed guard bed charged with a catalyst capable of removing arsenic therefrom under dearsenation conditions until the catalyst in the first guard bed is spent. The feedstock (shale oil) is then passed through a second guard bed, while a solvent capable of removing arsenic from the spent catalyst contained in the first guard bed is passed therethrough until the catalyst contained therein has been regenerated. When the catalyst in the second guard bed is spent, the process is reversed.

In this dearsenation process, lower temperatures and pressures are employed than in conventional dearsenation processes, the hydrogen requirements are reduced by 50%, and the catalyst is capable of absorbing eleven percent (11%) arsenic by weight before requiring regeneration. However, any process employing a fixed guard bed may be employed.

Generally speaking, any dearsenation catalyst (arsenic-removing absorbers) may be used in the process of this invention. Suitable dearsenation catalysts are well known in the art and include, but are not limited nickel, cobalt and molybdenum catalysts such as the oxides and sulfides of iron, nickel and cobalt, alone or in combination with a conventional support such as silica, alumina, magnesia, zirconia, thoria, zinc oxide, chromium oxide, silicon carbide, naturally occurring carriers or supports such as clays, Kieselguhr, Fuller's earth, pumice, bauxite, and the like. Especially preferred are demetallization catalysts such as 10% cobalt-molybdenum on alumina, 4% molybdenum on alumina, 2–4% nickel on silica, and nickel-molybdenum on alumina, preferably with a phosphorus promoter for best results.

Finished catalytic absorbents preferably have a surface are of at least 50 $m^2/gm$, with the most preferred surface areas being between 150 and 350 $m^2/gm$ for best results.

Typically, the dearsenation process is conducted at temperatures of from 500° to 850° F., preferably from 550° to 650° F. and most preferably at about 550° F., and pressures of from 0 to 1500 psig, preferably at least 500 psig. The preferred hydrogen/oil flow is 2,500 cu. ft. with hydrogen consumption of from 200–500 cubic feet, and a space velocity of 0.5 to 10 $hr^{-1}$, preferably 6 $hr^{-1}$ for best results.

Prior to regeneration, the spent catalyst in the guard bed is dried at a temperature of from 400°–600° F., preferably 500° F. in a nitrogen atmosphere.

After drying, a regeneration wash is passed through the guard bed at temperatures of from ambient temperature to 200° F., preferably from 70° F. to 150° F., pressures of 0 to 50 psig, preferably 20 psig, at a space velocity of from 2–10 $hour^{-1}$, preferably $6^{-1}$, for from 10 minutes to 2 hours, preferably about 30 minutes for best results, to remove the arsenic from the spent catalyst bed.

Suitable solvents comprising the regeneration wash include aqueous solutions having a pH of 7 or higher (alkaline). Since most commercially available demetallization catalysts are attacked by acidic solutions, it is preferred to avoid their use unless a catalyst which is not susceptible to acid erosion is employed.

After regeneration, and prior to further use, the catalyst is dried at a temperature of from 400°–600° F., preferably 500° F., and sulfided by treatment with 4–10%, preferably 8% for best results, by volume hydrogen sulfide gas in a hydrogen atmosphere. The catalyst may be sulfided wet or dry, but is preferably dry for best results.

The preferred process of this invention employs multiple guard beds. In the illustrative embodiment, two guard beds are shown, however, additional guard beds may be employed, if desired. In practice, the guard beds are charged with either a fixed bed of fresh or spent dearsenation catalyst (arsenic-removing absorbers). In the preferred embodiment which employs two guard beds, if fresh catalyst is used initially, the feedstock is passed through the active or first guard bed until it becomes saturated or spent, and is then diverted to the second guard bed where the dearsenation process is continued. At the same time, the spent catalyst in the first guard bed is regenerated by drying, washing and sulfiding. Preferably, the guard beds contain the same type of arsenic-absorbing catalysts, although in some circumstances it may be desirable to use different types of arsenic-absorbing catalysts.

One of the many advantages of the present invention is the ability to charge both or all, in the case of more than two, guard beds with spent catalyst, regenerate the catalyst in situ, and then proceed with the continuous dearsenation/regeneration process of this invention.

Figure 2:
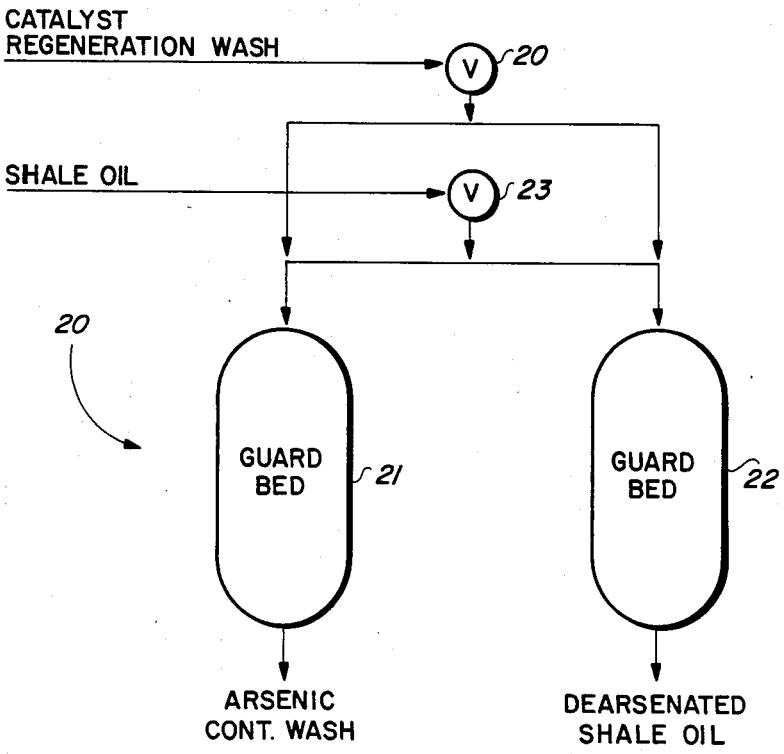
FIG. 2 is a schematic flow diagram depicting the multiple guard bed dearsenation process of FIG. 1 in an alternate phase of guard bed regeneration of the active guard bed depicted in FIG. 1.

As shown in FIGS. 1 and 2, multiple guard beds are employed in the practice of this invention to provide for the continuous removal of arsenic and simultaneous catalyst regeneration.

Referring to FIG. 1, a dual guard bed arrangement 10 is depicted. In practice, retorted shale oil feedstock, or other feedstocks containing at least 2 ppm of arsenic is passed downward through a first guard bed 11 under dearsenation conditions until the catalyst contained in the guard bed is spent. In initial operation, guard bed 12 is not employed, as each guard bed contains fresh, unspent dearsenation catalyst.

As shown in FIG. 2 which depicts a dual guard bed arrangement generally shown at 20, the flow of crude shale oil is then diverted downwardly through a second guard bed 22 via valve 23. While the feedstock is being passed through second guard bed 22 under dearsenation conditions, the spent catalyst in guard bed 21 is regenerated in situ by drying and treatment with a regeneration wash and vice versa thereafter when the feedstock is passed through the first guard bed. The flow of regeneration solvent solution is directed downwardly and alternately through the guard beds by valve means 24.

When the catalyst in the second guard bed 22 is spent, the process is reversed with the dearsenation step being carried out in guard bed 11 (FIG. 1) while the catalyst contained in second guard bed 12 is regenerated. The direction of flow of shale oil and catalyst-regeneration wash is controlled by valves 13 and 14, respectively.

The process may be repeated indefinitely, so long as the catalyst contained in the guard beds remain effective. In the event that repeated washings have diminished the effectiveness of the regenerated catalyst, the catalyst may be safely disposed of after the final regeneration cycle to remove the arsenic deposited thereon. In some circumstances, it may be desirable that either or both the shale oil and catalyst regeneration wash can be passed upwardly through the first and/or second guard bed. Particularly useful results can be obtained by passing the shale oil downwardly (downflow) through both guard beds and passing the catalyst regeneration wash upwardly (upflow) through both guard beds.

Preferred solvents providing the regeneration wash for catalyst regeneration according to the present invention are neutral and alkaline aqueous solutions (pH 7 and higher). While acidic solutions are also effective for removing arsenic from spent catalysts, such solutions also dissolve the catalyst metal, and hence are not suitable for the present purposes, unless a catalyst which is not soluble in acidic solutions is employed.

Figure 3:
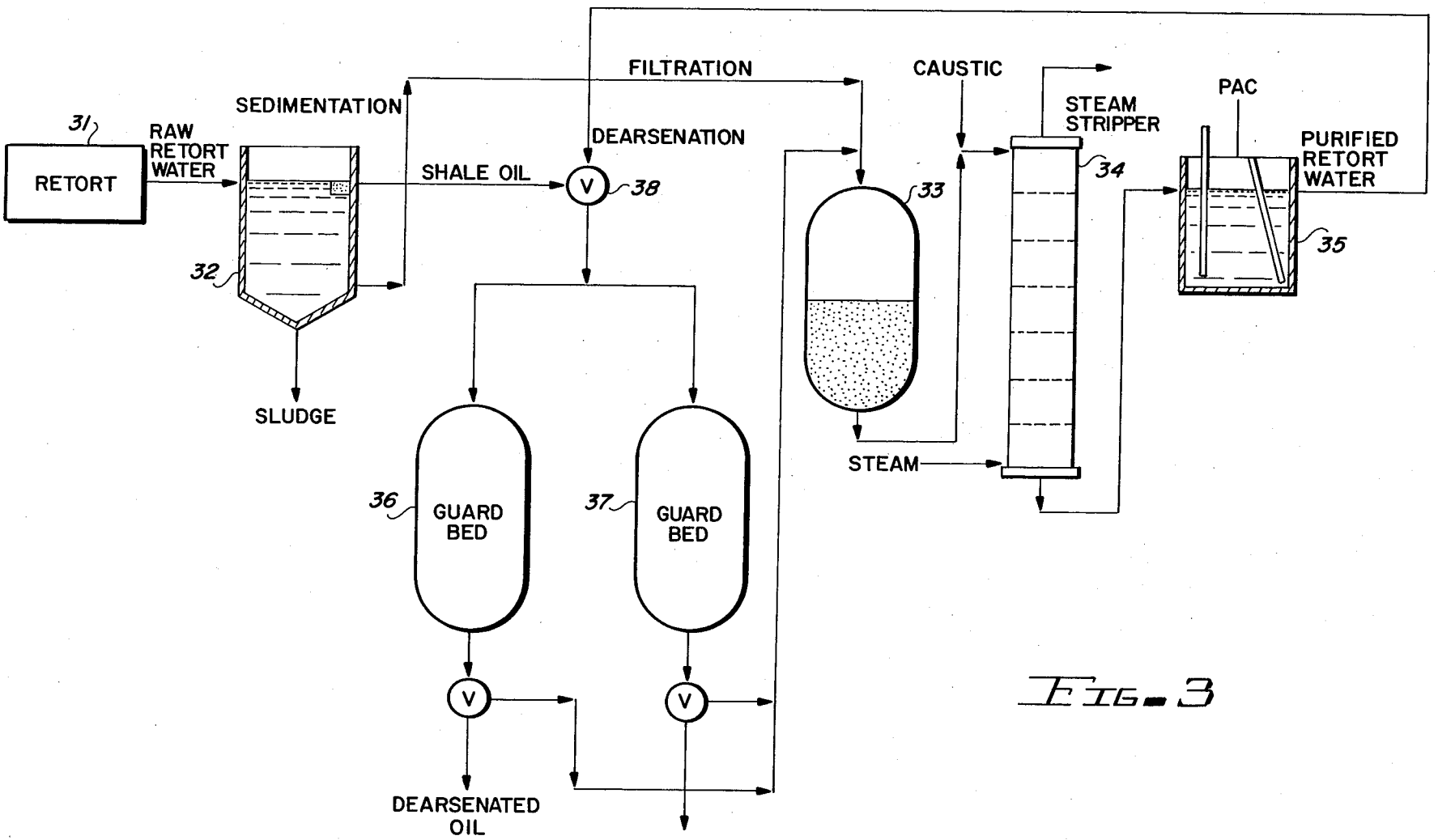
FIG. 3 is a schematic flow diagram of an oil shale retorting, dearsenation and retort water purification process wherein the continuous dearsenation and catalyst generation process of the present invention employs recycled purified retort water.

Referring to FIG. 3, a convenient source of catalyst regeneration wash solution is recycled retort water from an underground or an aboveground oil shale retort 31. The effluent product stream of hydrocarbons and oil shale retort water which is liberated during retorting, passes from the retorting operation to a clarifier, air flotation unit or other suitable water/oil separator 32 wherein the retort water is separated from the hydrocarbons and filtered in a granular filter such a sand filter 33 to remove shale oil and particulates from the retort water. Filtered oil shale water is passed through one or more steam strippers 34 to remove various other impurities such as ammonia, organic carbon, carbonates, phenols and sulfur. Caustic may be added to the stripper to raise the pH of the retort water. The water then passes into a tank 35 containing powdered activated carbon (PAC) and activated sludge, or alternatively, through granular activated carbon (GAC) absorber, followed by an activated sludge tank as described and shown in U.S. Pat. No. 4,495,056, which is hereby incorporated by reference herein. Other intermediate purification steps are typically included.

As shown in FIG. 3, the purified retort water is discharged from tank 35 and recycled and employed as the regeneration wash for guard bed 37. Simultaneously, separated shale oil from the retort 31 and/or other retorts is fed into the active guard bed 36 and dearsenated therein as previously described. When the catalyst in guard bed 36 is spent, the shale oil feed is diverted into guard bed 37 by valve 38 which also transfers the flow of purified retort water into spent guard bed 36.

The following examples further illustrate some aspects of the invention.

EXAMPLE 1

Figure 4:
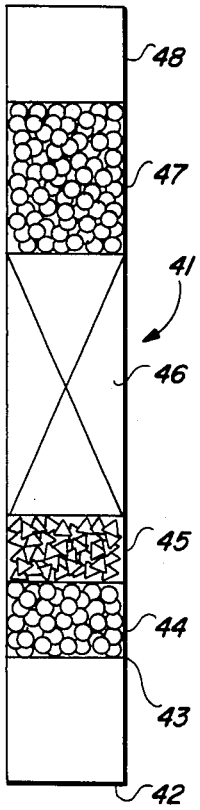
FIG. 4 is a cross-sectional view of the loading of one type of dearsenation guard bed employed in the practice of this invention.

Catalyst was loaded in a vertical pipe reactor guard bed as shown in FIG. 4. The catalyst was loaded in the vertical pipe reactor from the bottom up. Low surface area alumina balls were used at the reactor top to provide an oil preheat zone. The catalyst was dry sulfided with a 8% hydrogen sulfide and a 92% hydrogen gas mixture. After flushing the system with hydrogen, the desired temperature (650° F.), pressure (500 psig) and gas flow rate (2500 SCFB) were established, the feed pump was started, and the temperature was readjusted. Retort shale oil containing 4.5 ppm arsenic was fed into the guard bed for 200 hours. Thereafter, shale oil containing 34 ppm arsenic was fed through the guard bed for an additional 369 hours.

At the termination of the run, the feed pump, hydrogen supply and heaters were turned off sequentially. Then, the hydrogen pressure was dropped to atmospheric pressure and the system flushed with nitrogen. After the system cooled down, the catalyst were dumped from the bottom in four sections. The catalyst were hand picked from the mixture of catalyst and alumina chips. A part of each spent catalyst was dried at 500° F. in a nitrogen-purged oven for at least two hours. The weight losses after drying and calcining were determined. The calcined samples were analyzed for arsenic, iron and other methods using the EDAX method. Fresh catalyst samples were also analyzed at the same time. The results are shown in Tables I and II.

TABLE I

| SPENT CATALYST ANALYSIS | | | | | | |
|---|---|---|---|---|---|---|
| Catalyst | As | Fe | Zn | Se | Ca | S |
| Fresh | — | 0.04 | — | — | — | 1.0 |
| Bottom | 0.43 | 0.59 | 0.01 | 0.01 | 0.44 | 1.3 |
| Lower mid. | 0.84 | 0.89 | 0.05 | 0.01 | 0.53 | 1.2 |
| Upper mid. | 2.2 | 1.80 | 0.12 | — | 0.73 | 1.4 |
| Top | 9.0 | 4.10 | 0.28 | — | 0.81 | 1.5 |

TABLE II

| MATERIAL BALANCE | | | |
|---|---|---|---|
| Spent Catalyst I.D. | Wt of dried calcined catalyst (gms) | % Fe (gms) | % As (gms) |
| Bottom | 19.40 | 0.59(0.1106) | 0.43(0.0834) |
| Lower middle | 17.59 | 0.89(0.1566) | 0.84(0.1478) |
| Upper middle | 5.62 | 1.80(0.1012) | 2.2(0.1236) |
| Top | 13.62 | 4.10(0.5585) | 9.0(1.2258) |
| Total | 56.53 | 0.9269 | 1.5806 |
| Feed | 50.00 | 1.038 | 2.076 |
| % Recovered | | 89.3 | 76.1 |

EXAMPLE 2

A sample of the top portion of the catalyst employed in Example 1 was dried at 500° F. in a flowing nitrogen atmosphere and calcined at 1000° F. in flowing air. The weight loss on drying was 9% and the additional weight loss on calcination was 19%. The elemental analyses obtained by the EDAX method are set forth in Table III.

TABLE III

| Element | Weight Percent |
|---|---|
| As | 9.0 |
| Al | 42.0 |
| Mo | 3.4 |
| Ca | 0.81 |
| Fe | 4.1 |
| Ni | 0.24 |
| Zn | 0.28 |
| Mn | 0.05 |
| Se | — |

Based on previous studies which showed that a substantial amount of arsenic is normally lost during calcining, it was determined that the arsenic loss by material balance for this sample was 27 percent and that the sample actually contained 11 percent arsenic (dry weight basis) before calcination. In the following studies, the level of arsenic was assumed to be 11%.

EXAMPLE 3

A sample of spent catalyst in the top portion of Example 1 was dried at 500° F. under a nitrogen stream. Two grams (2 g) of the dried spent catalyst was mixed with distilled water (5 cc) in a glass beaker for 10 minutes. The catalyst was separated by filtration through a glass funnel using Watman filter paper #1. The filtered catalyst was dried at 500° F. in flowing nitrogen for two hours. Elemental analyses of the dried catalyst and filtrates are set forth in Table IV.

TABLE IV

| SOLVENT EXTRACTION OF SPENT CATALYST-DISTILLED WATER | | |
|---|---|---|
| Elements | Liquid Filtrate (ppm) | Leached Solids (%) |
| As | 490 | 6.1 |
| Mo | 630 | 2.5 |
| Al | 36 | 41 |
| Ca | 5 | 0.58 |
| Fe | 5.6 | 2.9 |
| Ni | 0.24 | 9.4 |
| Zn | 8.4 | 0.19 |
| Mn | 8.8 | 0.05 |
| Se | 23.0 | 0.06 |

EXAMPLE 4

A sample of spent catalyst in the top portion of Example 1 was dried at 500° F. under a nitrogen stream. Two grams (2 g) of the dried spent catalyst was mixed with 1N sodium hydroxide solution (5 cc) in a glass beaker for 10 minutes. The catalyst was separated by filtration through a glass funnel using Watman filter paper #1. The filtered catalyst was dried at 500° F. in flowing nitrogen for two hours. Elemental Analysis of the dried catalyst and filtrates are set forth in Table V.

TABLE V

| SOLVENT EXTRACTION OF SPENT CATALYST-1N NaOH (5 cc) | | |
|---|---|---|
| Elements | Liquid Filtrate (ppm) | Leached Solids (%) |
| As | 243 | 6.0 |
| Mo | 840 | 2.3 |
| Al | 2 | 40 |
| Ca | 0.3 | 0.66 |
| Fe | 0.1 | 2.8 |
| Ni | 1.0 | 0.15 |
| Zn | 2.5 | 0.18 |
| Mn | 0.1 | 0.05 |
| Se | 20.0 | 0.06 |

EXAMPLE 5

A sample of spent catalyst in the top portion of Example 1 was dried at 500° F. under a nitrogen stream. Two grams (2 g) of the dried spent catalyst was mixed with distilled water (20 cc) in a glass beaker for 10 minutes. The catalyst was separated by filtration through a glass funnel using Watman filter paper #1. The filtered catalyst was dried at 500° F. in flowing nitrogen for two hours. Elemental analyses of the dried catalyst and filtrates are set forth in Table VI.

TABLE VI

| SOLVENT EXTRACTION OF SPENT CATALYST-DISTILLED WATER | | |
|---|---|---|
| Elements | Liquid Filtrate (ppm) | Leached Solids (%) |
| As | 146.0 | 5.5 |
| Mo | 213.0 | 2.4 |
| Al | 6.9 | 41.0 |
| Ca | 0.3 | 0.57 |
| Fe | 0.1 | 2.7 |
| Ni | 2.7 | 0.14 |
| Zn | 2.9 | 0.18 |
| Mn | 2.3 | 0.06 |
| Se | 7.5 | 0.05 |

EXAMPLE 6

A sample of spent catalyst in the top portion of Example 1 was dried at 500° F. under a nitrogen stream. Two grams (2 g) of the dried spent catalyst was mixed with 1N sodium hydroxide (20 cc) in a glass beaker for 10 minutes. The catalyst was separated by filtration through a glass funnel using Watman filter paper #1. The filtered catalyst was dried at 500° F. in flowing nitrogen for two hours. Elemental analyses of the dried catalyst and filtrates are set forth in Table VII.

TABLE VII

| SOLVENT EXTRACTION OF SPENT CATALYST-1N NaOH—20 cc | | |
|---|---|---|
| Elements | Liquid Filtrate (ppm) | Leached Solids (%) |
| As | 146 | 5.5 |
| Mo | 400 | 2.3 |
| Al | 370 | 41 |
| Ca | 0.3 | 0.66 |
| Fe | 0.7 | 2.6 |
| Ni | 1.0 | 0.13 |
| Zn | 2.5 | 0.17 |
| Mn | 0.1 | 0.05 |
| Se | 22.0 | 0.07 |

While the process of this invention has been described in conjunction with recycled purified retort water as the regeneration wash, other sources of neutral or alkaline water may be employed.

Applicant's process of using and regenerating arsenic-removing catalysts to upgrade shale oil is effective and environmentally beneficial.

Although embodiments of the invention have been shown and described, it is to be understood that various modifications and substitutions, as well as various additions, rearrangements and combinations of process steps, can be made by those skilled in the art without departing from the novel spirit and scope of this invention.

What is claimed is:

1. A process for upgrading shale oil, comprising the steps of: passing shale oil laden with arsenic through a first fixed guard bed containing a catalyst capable of substantially reducing the arsenic content thereof until the catalyst in said bed is substantially spent; thereafter, directing the flow of fresh shale oil laden with arsenic to an intercommunicating second fixed guard bed containing a catalyst capable of substantially reducing the arsenic content thereof while regenerating the spent catalyst in said first guard bed in situ by contacting said spent catalyst with a water stream having a neutral or alkaline pH at a temperature of from ambient to 200° F. and pressures of from 0 to 50 psig at a space velocity of from 2–10 hour$^{-1}$ for a period of time sufficient to remove a substantial portion of said arsenic from said spent catalyst.

2. A process in accordance with claim 1 wherein said spent catalyst is dried prior to being contacted with said fluid stream.

3. A process in accordance with claim 2 wherein said catalyst is sulfided following treatment with said fluid stream.

4. A process in accordance with claim 1 wherein said water stream has a neutral pH and the catalyst in said fixed guard bed is regenerated at temperatures of from 70° to 150° F.

5. A process in accordance with claim 1 wherein said water stream has an alkaline pH and the catalyst in said fixed guard bed is regenerated at temperatures of from 70° to 150° F.

6. A process in accordance with claim 1 wherein shale oil retort water is employed as the fluid stream.

7. A process in accordance with claim 1 wherein said catalyst in said second guard bed is regenerated in situ after said catalyst is substantially spent.

8. A process in accordance with claim 7 wherein the flow of said fresh shale oil is directed to said first guard bed while said catalyst in said secon guard bed is being regenerated.

9. A process for producing and upgrading shale oil, comprising the steps of:

(a) retorting raw shale oil containing arsenic therein to liberate an effluent product stream comprising hydrocarbons and retort water;

(b) separating shale oil containing said arsenic from said effluent product stream;

(c) passing a portion of said shale oil through a first fixed guard bed comprising a catalytic absorber capable of substantially removing the arsenic therefrom at dearsenating conditions until the absorber in said first guard bed is substantially spent;

(d) passing another portion of said shale oil through a second fixed guard bed comprising a catalytic absorber capable of substantially removing the arsenic therefrom at dearsenating conditions while substantially stopping the flow of oil to said first guard bed; and (e) regenerating the spent catalytic absorber in said first guard bed in situ while said shale oil is being passed through said second guard bed by (i) drying the spent absorber in said first guard bed at a temperature of from 400°-600° F.; thereafter, (ii) contacting the dried, spent catalytic absorber with recycled oil shale retort water for from 30 minutes to two hours at a temperature of from 70° F. to 150° F. under pressures of from 20-50 psig at a space velocity of from 6-10 $hr^{-1}$ thereby substantially removing the arsenic contained in said spent catalytic absorber; and thereafter (iii) drying said catalytic absorber at a temperature of from 400° F. to 600° F.; and (iv) sulfiding said regenerated, dried catalytic absorber in said first bed.

10. A process in accordance with claim 9 wherein said fluid stream is a neutral or alkaline aqueous solution.

11. A process in accordance with claim 9 including substantially purifying said retort water and recycling said purified retort water for use as said fluid stream to regenerate said absorber.

12. A process in accordance with claim 9 wherein said absorbers in said first and second guard beds comprise similar catalysts.

13. A process in accordance with claim 11 including: substantially stopping the flow of said shale oil to said second guard bed; passing a further portion of said shale oil to said first guard bed; and regenerating said absorber in said second guard bed in a manner substantially similar to step (e).

14. A process in accordance with claim 13 wherein said shale oil is passed substantially downwardly through at least one of said guard beds.

15. A process in accordance with claim 13 wherein said shale oil is passed substantially upwardly through at least on of said guard beds.

16. A process in accordance with claim 13 wherein said contacting comprises passing said fluid stream substantially downwardly through at least one of said guard beds.

17. A process in accordance with claim 13 wherein said contacting comprises passing said fluid stream substantially upwardly through at least one of said guard beds.

* * * * *

UNITED STATES PATENT OFFICE
CERTIFICATE OF CORRECTION

Patent No. 4,719,006 Dated January 12, 1988

Inventor(s) SHRI K. GOYAL

It is certified that error appears in the above-identified patent and that said Letters Patent are hereby corrected as shown below:

Patent reads

| Col. | Line | |
|---|---|---|
| 5 | 25 | "limited nickel" should be -- limited to nickel -- |
| 7 | 17 | "such a sand" should be -- such as a sand -- |
| 11 | 6 | "secon" should be -- second -- |
| 12 | 28 | "on" should read -- one -- |

Signed and Sealed this

Thirtieth Day of August, 1988

*Attest:*

DONALD J. QUIGG

*Attesting Officer*

*Commissioner of Patents and Trademarks*